United States Patent [19]

Valdemarsson

[11] Patent Number: 4,825,182

[45] Date of Patent: Apr. 25, 1989

[54] ELECTRICAL SWITCHING DEVICE

[75] Inventor: Stefan Valdemarsson, Västerås, Sweden

[73] Assignee: Asea Aktiebolag, Västerås, Sweden

[21] Appl. No.: 120,423

[22] Filed: Nov. 13, 1987

[30] Foreign Application Priority Data

Nov. 18, 1986 [SE] Sweden ..... 8604924

[51] Int. Cl.[4] ..... H01H 9/00

[52] U.S. Cl. ..... 335/167; 200/440; 200/521

[58] Field of Search ..... 335/167–169, 335/172–176; 200/67 PK, 153 V, 153 SG, 250

[56] References Cited

U.S. PATENT DOCUMENTS 3,764,766 10/1973 Whitehead ..... 200/153 V
4,256,941 3/1979 Bachler .

FOREIGN PATENT DOCUMENTS 243352 3/1965 Austria ..... 200/250
673315 3/1939 Fed. Rep. of Germany .
1156254 12/1957 France ..... 200/67 PK

*Primary Examiner*—C. L. Albritton
*Assistant Examiner*—L. Donovan
*Attorney, Agent, or Firm*—Watson, Cole, Grindle & Watson

[57] ABSTRACT

The switching device has a contact arm which is fixed on a shaft in the form of a thick-walled tube and is turnable between a closed position and an open position under the influence of a torsion rod spring. At one of its ends the spring is fixedly connected to the contact arm and at its other end to a percussion hammer. In the closed position the spring is arrested in tensioned condition by means of a latch. When releasing the latch for opening of the switching device, the spring energy is transformed to rotation energy in the hammer and is transferred to the shaft by impact against a projection on the shaft. In this way the contacts of the switching device immediately attain a great separation velocity.

10 Claims, 2 Drawing Sheets

ELECTRICAL SWITCHING DEVICE

TECHNICAL FIELD

The present invention relates to an electrical switching device of the type comprising a contact arm which is fixed on a shaft mounted in a fixed contact block and is turnable between a closed position and an open position under the influence of a torsion rod spring, one end of which is fixedly connected to the contact arm or its shaft and the other end of which cooperates with a latching device which is adapted, in the closed position, to arrest the spring in tensioned condition, while said contact arm is pressed against a fixed counter contact for closing a current path through the contact arm. The switching device may, for example, be a current-limiting circuit-breaker or a current limiter arranged in series with a circuit-breaker, for example of the kind described in U.S. patent application Ser. No. 944,528.

BACKGROUND ART

It is previously known to use torsion rod springs as energy accumulator in operating devices for circuit-breakers. In prior art designs of this kind the springs are connected to the movable contact of the respective circuit-breaker via links or gear wheels (see e.g. German Patent No. 673 315 and U.S. Pat. No. 4,256,941). One advantage with springs of this kind is that they enable a rapid energy output since the mass of a torsion rod is concentrated near the axis of rotation, which causes the moment of inertia of the rod to become small. However, the fixed connection between the spring and the breaker contact in the prior art designs, in particular in breakers with butt contacts (i.e. contacts in which the direction of the contact movement is substantially perpendicular to the contact surface), results in a low velocity of contact separation during the first part of the contact opening phase. This renders the movement of the arc from the contact unit difficult, since a considerable amount of arcing gases containing metal vapour, etc., are generated at the contact unit before the contact gap reaches the minimum size (about 1 mm) necessary to enable a movement of the arc at all.

A further drawback in prior art designs is that the torsion spring has to be dimensioned to enable storage of relatively large energy, since the spring during the opening movement is counteracted by a contact pressure spring or some other contact pressure generating member.

DISCLOSURE OF THE INVENTION

The object of the present invention is to provide an electric switching device which, in addition to being capable of carrying high operating currents, is to be capable of efficiently limiting and possibly breaking short-circuit currents. In such a device it is necessary for the contact system of the device to be able to be opened in a very short time (<1 ms) and that the arc thus arising is rapidly removed from the contact surfaces. In order for the arc to be able to rapidly leave the contacts, a contact separation velocity of about 6 m/s is required as early as within 0.1 ms from the starting moment. This is achieved according to the invention by means of a switching device of the kind described under the heading "TECHNICAL FIELD" and in which the other end of the torsion spring (4) is fixedly connected to a percussion hammer (8), which is adapted, upon opening of the switching device after releasing of the latching device (9), to strike against a projection (10) fixedly arranged on the contact arm (1) or its shaft (2) to bring about a rapid contact opening.

By allowing one and the same torsion spring to serve both as contact pressure spring and opening spring and by allowing the energy for the opening to be transferred to the movable contact arm by a blow of a hammer, fixed to the torsion spring, several advantages are attained. By the blow of the hammer, the contact points will immediately attain a great separation velocity and the arc is able rapidly to travel out onto runner rails arranged adjacent to the contact unit. Since, in addition, the contact force automatically disappears during the opening, this solution requires a small stored spring energy (only 2–3 J at a contact force of 1 kN). In addition, the invention enables a simple design with few and robust parts, which ensures a high reliability.

According to a further development of the invention, the device is supplemented with at least one rod made of a high-magnetostrictive material which is adapted, in case of a short-circuit current, to influence the contact arm to bring about contact opening even before the impact from the percussion hammer occurs. With this solution an ultrarapid contact system can be achieved, in which the opening time, including a 1 mm contact gap when the arc leaves the contact, is less than 0.2 ms.

BRIEF DESCRIPTION OF THE DRAWING

The invention will be described in greater detail with reference to two embodiments shown in the accompanying drawing, wherein.

DESCRIPTION OF THE PREFERRED EMBODIMENTS

Figure 1:
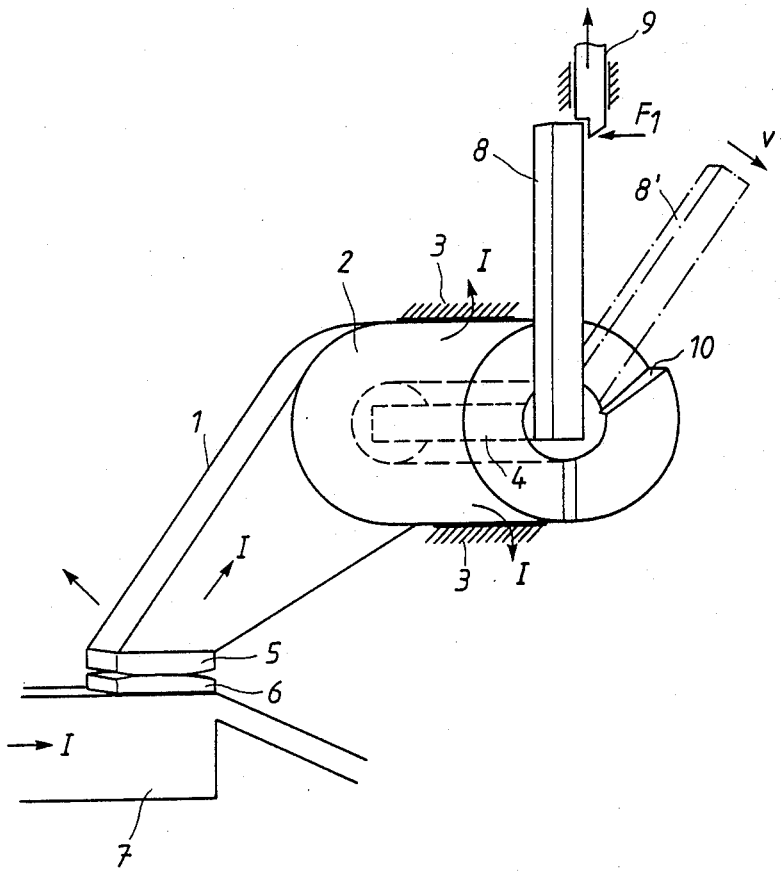
FIG. 1 shows a schematic perspective view of a first embodiment of a contact system for a current limiter constructed according to the invention.

The switching device shown in FIG. 1 has a contact arm 1 which is fixedly attached to a shaft 2 in the form of a thick-walled tube. The shaft 2 is journalled in a through-hole in a fixed contact block 3. The contact arm 1, the shaft 2 and the contact block 3 are made of an electrically conducting material, for example copper. The shaft 2 with the contact arm 1 is turnable between an on-position and an off-position under the influence of a torsion rod spring 4. In the on-position the contact arm 1 is pressed via contact elements 5, 6 against a fixed contact carrier 7, whereby a current I is able to flow between the contact carrier 7 and the contact block 3 according to the arrows shown in FIG. 1.

The torsion rod spring 4 is fixedly connected at one end to the contact arm 1 and at the other end to a percussion hammer 8. When the free end of the hammer 8 is subjected to a force $F_1$, the spring 4 is tensioned and the contact pressure arises. In the on-position the hammer 8 and the spring 4, tensioned in this position, are arrested by a latch 9. When a short-circuit occurs in the circuit into which the device is connected, the latch 9 is immediately withdrawn from the free end of the hammer 8, for example by action of an electrodynamic force originating from a capacitor discharge current. When the free end of the hammer 8 is released, the energy stored in the torsion rod spring 4 is transformed into rotation energy in the hammer 8, which is indicated in FIG. 1 by the arrow v and the instantaneous position 8' of the hammer 8 shown in long chain lines. After a certain acceleration distance, the hammer 8 hits a projection 10 arranged on the free end of the thick-walled tube 2, whereby part of the energy is transferred to the tube 2. How large a part of the energy that is transferred through the impact is dependent on the relationship between the masses of the parts 4, B and 1, 2. By the impact of the hammer 8 against the projection 10, the contact points between the elements 5, 6 immediately attain a great separation velocity and the arc can be rapidly moved from the contact unit and travel out onto the runner rails, for example as shown in the above-mentioned U.S. patent application No. 944,528.

An important advantage with this design is that a great contact force can be attained by simple means, for example 2 kN in a device with a rated current of 1 kA, and despite this obtain a very rapid contact opening. This is due, among other things, to the contact force being reduced during the movement of the hammer and being practically zero when the impact against the projection 10 occurs. In that way only relatively little energy is needed for the opening of the device. Furthermore, since as opening spring there is used a torsion rod, the mass of which is located near the axis of rotation of the rod and therefore has a small moment of inertia and a high resonance frequency (e.g. of the order of magnitude of 1 kHz for the spring 4 together with the hammer 8), the time taken for the movement of the hammer 8 from the point where it is released from the latch 9 to the point where it hits the projection 10 will be very short (e.g. 0.2 ms).

The contact elements 5, 6 may suitably be made of silver or a silver alloy, which together with the great contact force of 1 kN or above results in the transition resistance in the contact unit being relatively small. Since in the closed position the same great contact force prevails between the shaft 2 and the contact block 3, where the contact surfaces are relatively large, the transition resistance at this location will be even smaller than between the contact elements 5, 6.

To avoid damage by burning on bearing surfaces between the shaft 2 and the block 3 when the contact force disappears in connection with the contact opening, the contact arm 1 is connected to the block 3 via a flexible conductor (not shown in the figure) Since this conductor only need to carry current during the time from the contact opening until the arc has been extinguished or travelled out onto runner rails, which have been arranged near the contacts, this conductor may be relatively thin.

With the design shown in FIG. 1, an opening time, including a 1 mm contact gap when the arc leaves the contact unit, of 0.4–0.5 ms can be achieved.

Figure 2:
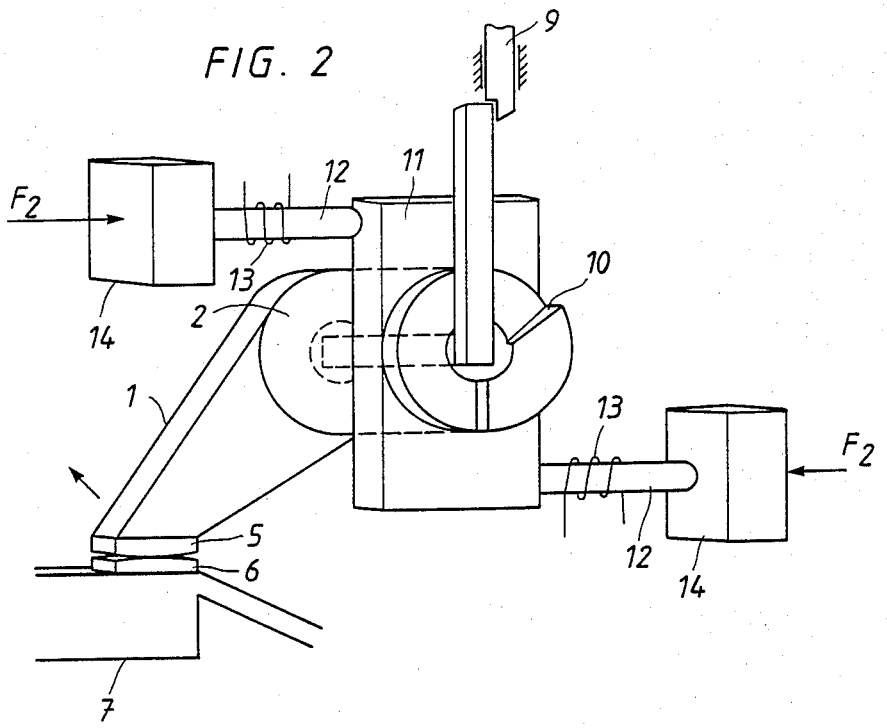
FIG. 2 shows in the same way a second embodiment of such a contact system.

FIG. 2 shows an improved design, in which the opening time can be reduced to less than 0.2 ms. In this design the embodiment according to FIG. 1 is supplemented with a bracket 11 which is fixedly connected to the shaft 2. In the diagonally opposite corners of the bracket 11, two rods 12 of high-magnetostrictive material and with excitation windings 13 are arranged in such a way that the extension of the rods 12 leads to a rotary motion of the bracket 11 and hence a contact opening. The material in the rods 12 may be an alloy between the metals terbium and iron, for example of the kind described in U.S. Pat. No. 4,308,474. With such material, an extension of the order of magnitude of 1 per mille may be obtained by magnetic influence. As counter support against the extension of the rods 12 a mass (counter weight) 14 is arranged at the outer end of each rod 12. The mass 14 is pressed against the end of the rod 12 by means of a weak spring force $F_2$.

Figure 3:
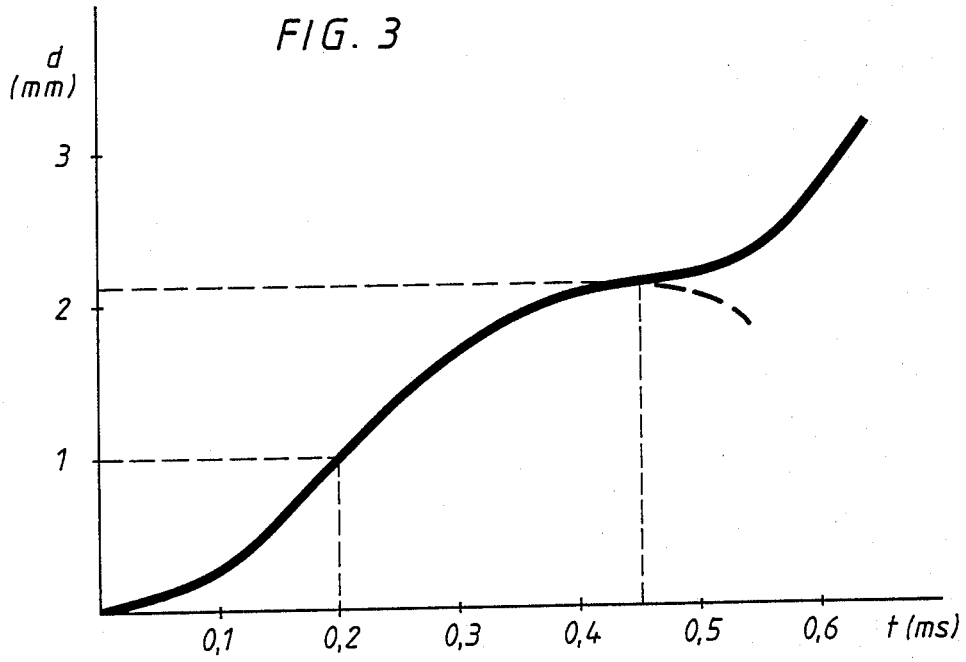
FIG. 3 shows a curve of the contact gap as a function of time after a short-circuit current has been detected in a contact system according to FIG. 2.

FIG. 3 shows a curve of the contact gap d versus the time t for the switching device according to FIG. 2 during the first part of an opening movement. At the time t=0, an overcurrent is detected and a current surge is sent through the excitation windings 13. In this way the desired rapid extension of the rods 12 is obtained, and even after a time of about 0.2 ms a contact gap of 1 mm has been attained, which is sufficient for the arc to be able to move from the contact unit. At approximately the same time (i.e. at t=0.2 ms), the hammer 8 is released from the latch 9, and after an additional 0.25 ms (i.e. at t=0.45 ms), the hammer 8 strikes against the projection 10. The mechanism described with reference to FIG. 1 then completes the contact opening to full insulation distance in a time of less than 3 ms.

The invention is not limited to the embodiments shown but can be materialized in several different ways within the scope of the claims. For example, the device can be constructed with two or more parallel contact arms 1, whereby the rated current of the device can be increased. The contact arms 1 need not, of course, be arranged at one end of the tubular shaft 2 but may, for example, be located in the middle of the shaft 2, one end of the shaft 2 being formed with the projection 10 and the other end being fixedly connected to the torsion spring 4 arranged in the shaft 2.

I claim:

1. An electric switching device comprising a contact arm (1) which is fixed on a shaft (2) rotatably mounted in a fixed contact block (3) and being turnable between a closed position and an open position under the influence of a torsion rod spring (4), one end of which being fixedly connected to the contact arm (1) or the shaft (2) and the other end of which being fixedly connected to a percussion hammer (8), which cooperates with a latching device (9) which is adapted, in the closed position, to arrest the torsion rod spring (4) in tensioned condition, while the contact arm (1) is pressed against a fixed counter contact (7) for closing a current path through the contact arm (1), the percussion hammer being adapted, upon opening of the switching device after releasing of the latching device (9), to strike against a projection (10) fixedly arranged on the contact arm (1) or the shaft (2) to bring about a rapid contact opening.

2. Switching device according to claim 1, in which the shaft (2) consists of a tube surrounding the torsion spring (4).

3. Switching device according to claim 2, in which the shaft (2) is provided at one end with said contact arm (1) and at the other end with said projection (10).

4. Switching device according to claim 2, in which the contact arm (1) is arranged substantially in the middle of the shaft (2), which at one end is provided with said projection (10) and at the other end is fixedly connected to the torsion rod spring (4).

5. Switching device according to claim 1, in which the haft (2) and the contact block (3) are made of an electrically conductive material such as copper nd are included in said current path.

6. Switching device according to claim 1, further comprising at least one rod (12) made of magnetostrictive material which is adapted, in the case of a short-circuit current, to influence the contact arm (1) to bring about contact opening even before the percussion hammer (8) strikes against the projection (10).

7. Switching device according to claim 6, in which a bracket (11) is fixed on the tubular shaft (2) and the magnetostrictive rod (12) is connected to the bracket (11) such that an extension of the rod (12) leads to a rotary motion of the bracket (11).

8. Switching device according to claim 7, in which as counter support against the extension of the rod (12) there is arranged a mass (14) which, with the aid of a resilient member, is pressed against that end of the rod (12) facing away from the bracket (11).

9. Switching device according to claim 1, in which the contact arm (1) and the contact block (3) are connected via a flexible conductor.

10. Switching device according to claim 1, further comprising runner rails arranged adjacent to the contact means of the switching device in such a way that the arc produced upon contact opening, while being influenced by the magnetic field generated by the current, is rapidly moved away from the contact.

* * * * *